US010598008B2

(12) United States Patent
Cour

(10) Patent No.: US 10,598,008 B2
(45) Date of Patent: Mar. 24, 2020

(54) DRILLING METHOD, METHOD FOR PERFORMING A PRESSURE METER TEST, AND CORRESPONDING ASSEMBLY

(71) Applicant: CALYF, Maisons Laffitte (FR)

(72) Inventor: Francis Cour, Maisons-Lafitte (FR)

(73) Assignee: CALYF, Maisons Laffitte (FR)

( * ) Notice: Subject to any disclaimer, the term of this patent is extended or adjusted under 35 U.S.C. 154(b) by 166 days.

(21) Appl. No.: 15/565,622

(22) PCT Filed: Apr. 8, 2016

(86) PCT No.: PCT/EP2016/057814
§ 371 (c)(1),
(2) Date: Oct. 10, 2017

(87) PCT Pub. No.: WO2016/162513
PCT Pub. Date: Oct. 13, 2016

(65) Prior Publication Data

US 2018/0080315 A1 Mar. 22, 2018

(30) Foreign Application Priority Data

Apr. 10, 2015 (FR) ..... 15 53142

(51) Int. Cl.

| | |
|---|---|
| ***E21B 43/10*** | (2006.01) |
| ***E21B 47/06*** | (2012.01) |
| ***E21B 49/00*** | (2006.01) |
| ***E21B 7/20*** | (2006.01) |
| *E21B 1/00* | (2006.01) |

(52) U.S. Cl.
CPC ..... *E21B 49/00* (2013.01); *E21B 7/20* (2013.01); *E21B 43/105* (2013.01); *E21B 43/108* (2013.01); *E21B 47/06* (2013.01); *E21B 1/00* (2013.01)

(58) Field of Classification Search
CPC ..... E21B 43/105; E21B 43/108; E21B 47/06; E21B 7/20
See application file for complete search history.

(56) References Cited

U.S. PATENT DOCUMENTS

| | | | | |
|---|---|---|---|---|
| 3,005,504 | A | 10/1961 | Mayhew, Jr. | |
| 3,945,444 | A | 3/1976 | Knudson | |
| 4,279,299 | A * | 7/1981 | Shuck | E21B 37/00 166/277 |
| 6,106,200 | A | 8/2000 | Mocivnik et al. | |
| 6,164,126 | A * | 12/2000 | Ciglenec | E21B 49/10 73/152.01 |
| 2012/0181004 | A1 | 7/2012 | Nikiforuk | |

OTHER PUBLICATIONS

Search Report dated Jan. 28, 2016 in corresponding FR Application No. 1553142.

* cited by examiner

*Primary Examiner* — David J Bagnell
*Assistant Examiner* — Dany E Akakpo
(74) *Attorney, Agent, or Firm* — Knobbe, Martens, Olson & Bear, LLP

(57) ABSTRACT

A method for drilling into the ground includes digging a longitudinal hole in the ground, and simultaneously lining the hole with a tube extending substantially over an entire longitudinal length of the hole. The tube includes an inner tube and an outer tubular sheath inserted between the inner tube and a wall of the hole. After digging the hole, the inner tube is removed from the hole, with the outer sheath remaining in place inside the hole.

15 Claims, 3 Drawing Sheets

Figure 1:
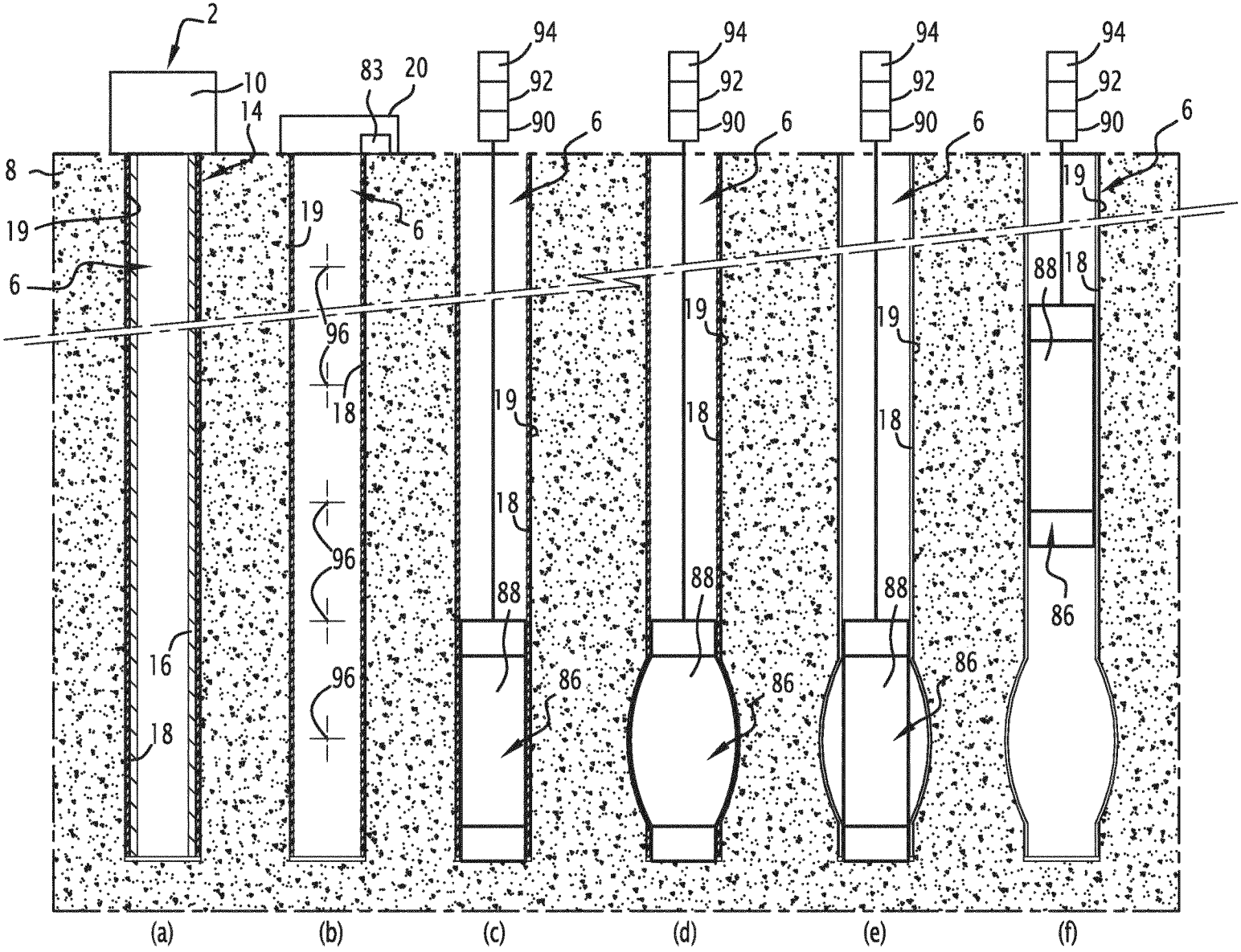

DRILLING METHOD, METHOD FOR PERFORMING A PRESSURE METER TEST, AND CORRESPONDING ASSEMBLY

CROSS-REFERENCE TO RELATED APPLICATIONS

This application is a U.S. National Phase under 35. U.S.C. § 371 of International Application PCT/EP2016/057814, filed Apr. 8, 2016, which claims priority to French Patent Application No. 1553142, filed Apr. 10, 2015. The disclosures of the above-described applications are hereby incorporated by reference in their entirety.

The invention generally relates to drilling methods, in particular using pressure meter borings of the Menard type, done according to standard NC P 94-110 dated July 1991 ("the Standard").

More specifically, according to a first aspect, the invention relates to a method for drilling into the ground, comprising the following step:

digging a longitudinal hole in the ground, and simultaneously lining the hole with a tube extending substantially over an entire longitudinal length of the hole.

A pressure meter boring is a set of successive operations consisting of performing a pressure meter boring and performing, in this boring, one or several pressure meter tests.

A pressure meter boring consists of producing, in the ground, a cylindrical pit with a circular cross-section, in which the pressure meter probe is introduced. The quality of the pressure meter test and that of the production of the drilling beforehand are closely linked. Consequently, the Standard requires performing the pressure meter testing in passes, the pass lengths not being able to exceed maximum values set out by the Standard.

The test makes it possible to obtain a ground deformability characteristic, called the Menard pressure meter modulus $E_M$, an ultimate strength characteristic, called ultimate pressure meter pressure $p_l$, and a characteristic pressure, called pressure meter creep pressure $p_f$.

Two types of probe can be used depending on the nature and condition of the ground:

a flexible sheath probe;

a flexible sheath probe placed in a slotted tube.

The ultimate strength specific to the pressure meter probe, including any slotted tube, must be as low as possible relative to the ultimate pressure meter pressure of the ground. The probe must be capable of reaching a diametrical expansion rate of 50% relative to its diameter at rest. The ultimate strength specific to the probe is equal to the pressure of the injection liquid necessary to reach the expansion rate of 50% in the air. This specific ultimate strength must typically be less than 2.5 bars.

Practically, the bare flexible sheath probe is chosen depending on the type of terrain. The ultimate strength specific to the bare flexible sheath probe must typically be less than 1.5 bars. This specific ultimate strength is equal to the pressure of the injection liquid necessary to reach the expansion rate of 50% in the air of the bare flexible sheath probe.

The slotted tube is a steel tube, typically bearing six equidistant slots. The nature and thickness of the material are chosen so that the ultimate strength specific to the slotted tube alone does not exceed 1 bar. This specific ultimate strength is equal to the additional pressure of the injection liquid necessary for the entire probe to reach the expansion rate of 50% in the air, relative to a bare flexible sheath probe. In other words, the specific ultimate strength of the slotted tube alone is equal to the difference between the specific ultimate strength of the complete probe and the specific ultimate strength of the bare probe.

The slotted tube serves to protect the probe from attacks from the terrain, during the phase for lowering the probe into the borehole, then during the inflation phase to conduct the test, and raising it again.

A pressure meter drilling technique known as "Slotted Tube with Simultaneous Material Removal" (STMR) has been developed to eliminate the obligation to drill in passes, which is the result of the absence of means for supporting the hole after raising the drilling tube. The STMR technique makes it possible to place such support means, simultaneously or immediately after attacking the terrain with the drilling tool. Concretely, the STMR technique consists of pushing into the terrain, by percussion or jacking, a lining whereof the lower section is made up of a slotted tube element, according to the specifications of the Standard for slotted tube probes. During penetration, the lining acts as a corer. The materials that penetrate the lining are broken up and brought up to the surface using ad hoc tools (retro-jets, rotary tools, etc.). Once maximum penetration is achieved, the flexible sheath pressure meter probe is lowered to the slotted tube element, then the tests are carried out by raising the lining in steps. This STMR technique makes it possible to ensure precise cutting of the hole and complete support for the walls of the hole until the tests have been carried out. However, in practice, its use has been very limited due to waste problems in most terrain other than loose sand and soft clay, and the very low efficiency of tools for breaking up materials cored by the tube.

The performance of the STMR technique was improved by combining it with the ODEX technique for drilling with simultaneous lining of the hole, commonly used in the mining field. The ODEX technique makes it possible to drill the terrain with a destructive tool done at the bottom of the lining by rotary percussion and, at the same time, raising the destroyed materials toward the surface using the drilling fluid circulating inside the lining. The lining is lowered without rotation.

A lining implemented using the ODEX technique must withstand the stresses imposed during the drilling phase, which, in common applications where the lining elements are solid (not slotted), is not problematic.

Conversely, in the specific case of the application of the STMR technique, the presence, in the lower part of the lining, of a slotted tube element is problematic. Indeed, according to the Standard, the specific ultimate strength of the slotted tube must not exceed 1 bar. This value is substantially lower than the pressure of the drilling fluid circulating inside the lining. This causes a risk of opening of the slots of the slotted tube, and therefore passage of the drilling fluid toward the outside. The drilling fluid can then circulate between the lining and the wall of the hole, which risks causing the wall of the hole to break up, which is detrimental to the drilling quality.

In this context, the invention aims to propose a drilling method in the ground that is better suited to carrying out pressure meter tests.

To that end, the invention relates to a drilling method of the aforementioned type, characterized in that the tube includes an inner tube and an outer tubular sheath inserted between the inner tube and a wall of the hole, the method comprising, after the step of digging the hole, a raising step during which the inner tube is removed from the hole, the outer sheath remaining in place inside the hole.

The new method therefore makes it possible to perform the drilling with a traditional drilling technique with lining being advanced using the ODEX technique or a similar technique, adding, to the lining, a thin-walled sheath, lowered into the ground simultaneously with the inner tube. Once the drilling is complete, the inner tube is raised, while the sheath is left in place in the ground, providing support for the wall of the hole. The drilling equipment can therefore be demobilized at an early stage.

The pressure meter tests are, if available, carried out later, with the appropriate testing equipment. The pressure meter probe is lowered inside the sheath, to the maximum depth required for the tests. The pressure meter tests are then carried out during raising. In each test, the sheath plays the role of the slotted tube commonly implemented with traditional pressure meter probes. The sheath therefore has two functions:

supporting the walls of the hole;

during the pressure meter test, protecting the probe.

To satisfy the first function, the outer sheath 18 is in fact provided not to deform under the effect of an outside radial pressure comprised between 0.2 and 2 bars, preferably comprised between 0.5 and 1.5 bars, for example applied over a height of 1 m. This means that such a pressure for example applied on the ground on the outer surface of the sheath will not cause the sheath to break, or cause a tear, or cause local pushing in by more than 5 mm.

To satisfy the second function, the outer sheath 18 has a specific ultimate strength of less than 1 bar, preferably less than 0.8 bars, still more preferably less than 0.6 bars. As previously described, the specific ultimate strength of the outer sheath is equal to the difference between the specific ultimate strength of the complete probe (pressure meter probe+outer sheath) and the specific ultimate strength of the pressure meter probe without the outer sheath. It corresponds to the additional injection liquid pressure to be applied in order for the complete probe to reach an expansion rate of 50% in the air, relative to the pressure meter probe alone without the outer sheath.

Thus, the inner tube, which is relatively more rigid, imparts good strength to the tube during the step for digging the hole, and thus avoids any deformation of the tube. After this inner tube has been removed, only the outer sheath remains in place inside the hole. The outer sheath is less rigid, and therefore opposes a lower strength during any pressure meter tests.

Typically, the inner tube has a specific inner strength greater than 1 bar, defined as before, preferably greater than 1.5 bars. This in particular comes from the fact that the inner tube is solid.

The method may also have one or more of the features below, considered individually or according to any technically possible combinations.

- the outer sheath is made from a plastic material;
- the outer sheath has a thickness comprised between 1 and 4 mm;
- the inner tube has an outer diameter, the outer sheath having an inner diameter, the difference between the inner diameter and the outer diameter being comprised between 2 and 8 mm;
- the outer sheath has longitudinal weak spots, distributed on the periphery of the outer sheath;
- the weak spots are made after placing the outer sheath inside the hole; and
- the outer sheath is blocked in position during the raising step.

According to a second aspect, the invention relates to a method for carrying out a pressure meter test, the method comprising:

- a step for drilling a hole in the ground and a step for raising the inner tube, using the method according to any one of the preceding claims;
- a step for inserting a pressure meter probe into the outer sheath;
- a measuring step during which a deformable cell of the pressure meter probe is inflated by a fluid, the cell radially stressing the outer sheath against the wall of the hole.

The method for carrying out a pressure meter test may further provide that the measuring step is repeated in several positions distributed longitudinally along the hole, by moving the pressure meter probe successively from a bottom of the hole toward an inlet of the hole, the outer sheath not being moved.

According to a third aspect, the invention relates to an assembly for drilling in the ground, the assembly including:

- a digging device, comprising a tool for drilling a longitudinal hole in the ground;
- a tube suitable for extending substantially over an entire longitudinal length of the hole, the tube comprising an inner tube and an outer tubular sheath inserted between the inner tube and a wall of the hole;
- a device for placing the tube in the hole simultaneously with the digging;
- a device for removing, after digging the hole, the inner tube from the hole, the outer sheath remaining in place inside the hole.

The drilling assembly is provided to carry out the drilling method described above.

Conversely, the drilling method according to the invention is provided to be carried out by the above drilling assembly.

The drilling assembly according to the invention may further have the features below:

- the tube comprises a plurality of members connecting the outer sheath and the inner tube to one another, arranged such that the inner tube is longitudinally connected to the outer sheath in translation toward a bottom of the hole, and is longitudinally free relative to the outer sheath in translation toward an inlet of the hole;
- the inner tube comprises a plurality of tube segments connected to one another by inner connecting ferrules;
- the outer sheath comprises a plurality of sheath segments connected to one another by outer connecting ferrules;
- each connecting member being supported by one of an inner connecting ferrule and an outer connecting ferrule and cooperating with the other of an inner connecting ferrule and an outer connecting ferrule to connect the inner tube longitudinally to the outer sheath in translation toward the bottom of the hole.

According to a fourth aspect, the invention relates to an assembly for carrying out a pressure meter test, said assembly comprising:

- the assembly for drilling in the ground described above;
- a pressure meter probe able to be inserted into the outer sheath, including a deformable cell;
- a device provided to inflate the deformable cell using a fluid, such that the cell radially stresses the outer sheath against the wall of the hole.

This assembly for carrying out the pressure meter test may further include a device for moving the pressure meter probe successively to several positions distributed longitudinally along the hole, from a bottom of the hole toward an inlet of the hole, without moving the outer sheath.

Figure 2:
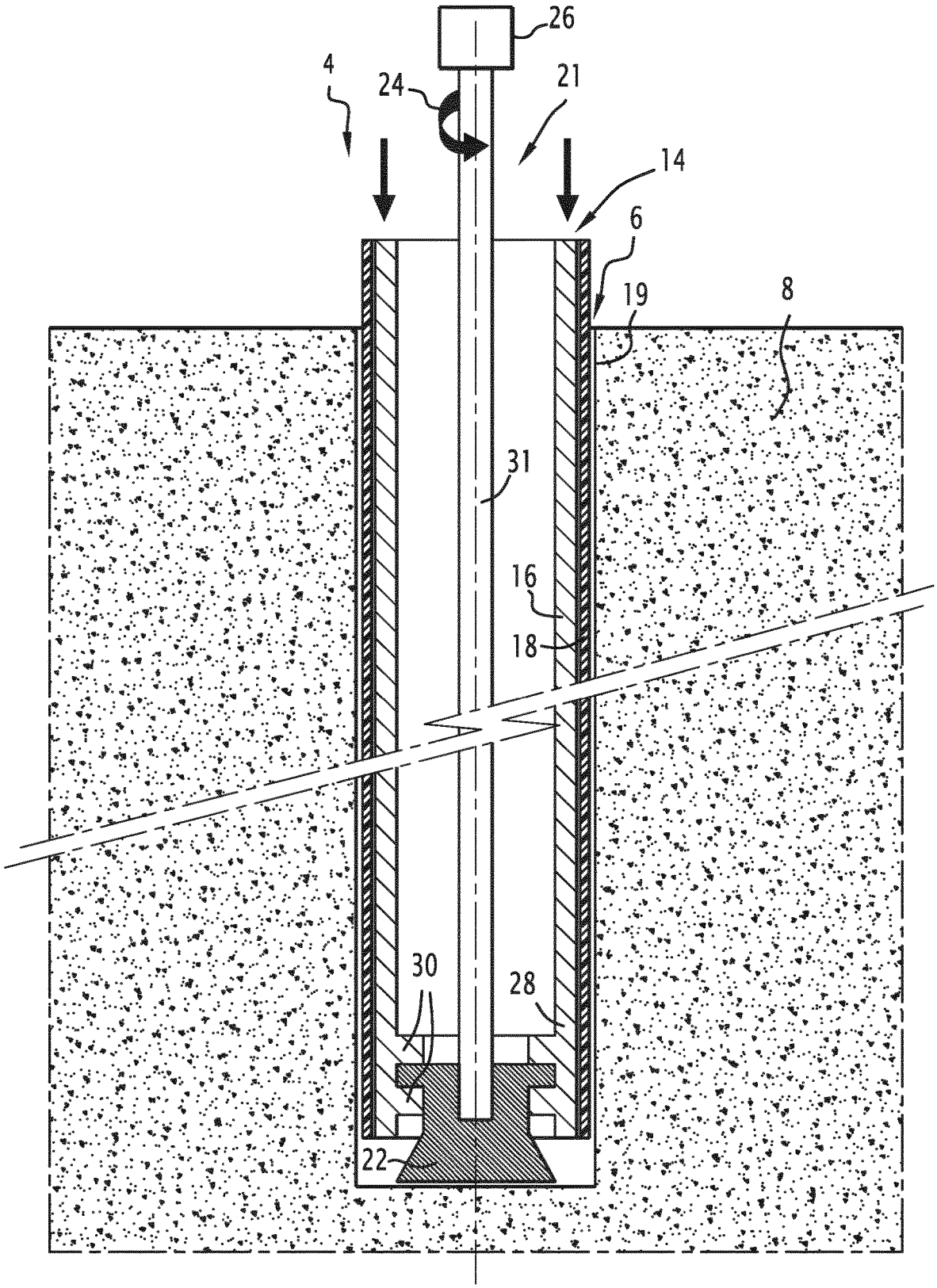
Figure 3:
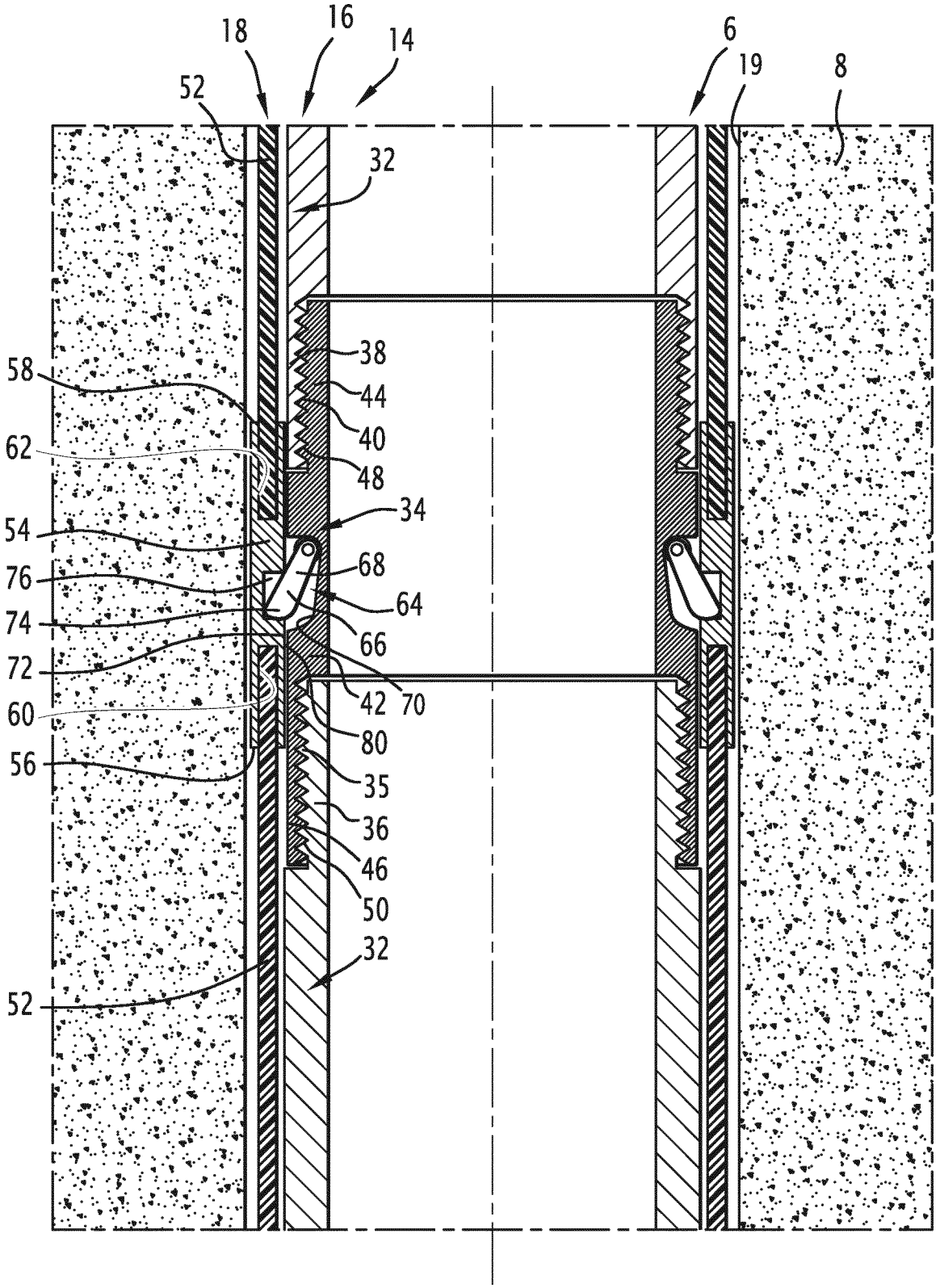

Other features and advantages of the invention will emerge from the detailed description above, provided for information and non-limitingly, in reference to the appended figures, in which:

FIG. 1 schematically shows different steps of the method for carrying out a pressure meter test according to the invention;

FIG. 2 is a simplified schematic illustration of the step for digging the hole of the method of FIG. 1; and FIG. 3 is an enlarged schematic illustration of the outer sheath and the inner tube used in the method according to the invention.

The assembly 2 shown in FIG. 1 is intended to carry out a pressure meter test, in order to characterize the nature and behavior of the ground. This ground may be of any type: sand, clay, soft rock, hard rock, etc.

As shown by FIG. 1, the assembly 2 includes means intended to drill a hole in the ground, and means intended to perform the pressure meter test strictly speaking.

It should be noted that the hole drilled in the ground could be used for other purposes, different from carrying out a pressure meter test. It could for example be used to produce a log, in gamma rays or electrical resistance. It could also be used to take seismic measurements. For these types of tests and measurements, it is advantageous for the terrain to be worked as little as possible, and for the lining not to be a very thick steel tube.

As shown in FIG. 1, the assembly 2 includes a device 4 (FIG. 2) for digging a longitudinal hole 6 in the ground 8, and a device 10 for placing a tube 14 in the hole simultaneously with the digging (FIG. 1*a*).

The hole is typically oriented vertically. Alternatively, it is inclined relative to the vertical, or even horizontal.

The hole is rectilinear. It typically has a circular, or substantially circular, straight section.

Because the hole 6 is lined simultaneously with the drilling, the tube 14 extends substantially over the entire longitudinal length of the hole 6. The device 10 is suitable for pushing the tube 14 gradually into the hole 6, over the course of the digging of the hole 6.

As shown in FIGS. 1 and 2, the tube 14 comprises an inner tube 16 that is relatively more rigid, and a tubular outer sheath 18, relatively less rigid, inserted between the inner tube 16 and a wall 19 of the hole.

The inner tube and the outer sheath both extend substantially over the entire longitudinal length of the hole.

As shown by FIG. 1, the drilling assembly 2 further includes a removal device 20, provided, after digging the hole 10, to raise the inner tube 16 outside the hole, the outer sheath 18 remaining in place inside the hole 10 (FIG. 1*b*).

The inner tube 16 is made from a metal material, for example steel. It has a thickness greater than 2 mm. Typically, it has a thickness comprised between 2 and 10 mm. In the example shown in FIG. 3, it has a thickness of 7 mm. It is solid.

The outer sheath 18 is typically made from a plastic material, preferably a rigid and breakable plastic material. For example, it is made from polycarbonate or acetate. It has a thickness typically comprised between 1 and 4 mm, for example between 2 and 3 mm. In the example shown in FIG. 3, the sheath has a thickness of 2 mm.

So as to allow the inner tube to be removed without difficulty, the difference between the inner diameter of the sheath and the outer diameter of the tube is comprised between 2 and 8 mm. In the illustrated example, this difference is equal to 4 mm.

Furthermore, the outer diameter of the sheath 18 is chosen to be slightly smaller than the nominal inner diameter of the hole to be drilled. Typically, the difference between the nominal inner diameter of the hole and the outer diameter of the sheath is comprised between 1 and 8 mm, and is equal to 4 mm in the example shown in FIG. 3. In practice, the wall of the hole tends to collapse slightly with time, such that the terrain comes into contact with the outer sheath.

The digging device 4 is of any appropriate type. Typically, the digging device comprises a drilling tool 21 using rotary percussion, of the type shown in FIG. 2.

The tool 21 comprises a drilling head 22 mounted rotating on the inner tube 16, a device 24 for rotating the drilling head 22 relative to the inner tube 16, and a device 26 provided to transmit longitudinal percussion to the drilling head 22 through the inner tube 16.

The drilling head 22 is of any type suitable based on the terrain. It is mounted on a lower end 28 of the inner tube. It protrudes longitudinally toward the bottom of the hole 10 relative to the inner tube and the outer tube. The drilling had 22 is typically guided in rotation relative to the inner tube by reliefs arranged on the inner surface of this tube, such as the ribs 30 shown in FIG. 2.

The driving device 24 typically includes a motor situated outside the hole 10, and a set of rods 31 transmitting the torque from the motor to the drilling head 22. The inner end of the set of rods 31 is rigidly fastened to the drilling head 22. The set of rods 31 is rotated by the motor.

The percussion device 26 is of any suitable type. The percussion generated by the device 26 is transmitted to the drilling head by the set of rods 31, the latter transmitting the percussion in turn to the inner tube 16 so as to pull the latter toward the bottom of the hole as the drilling advances. Alternatively or additionally, the percussion generated by the device 26 is transmitted directly to the inner tube 16, the inner tube 16 in turn transmitting the percussion to the drilling head 22.

The digging device 4 typically includes a unit (not shown) for injecting a drilling fluid inside the inner tube 16. The drilling fluid makes it possible to evacuate the materials excavated by the drilling head.

As shown in FIG. 3, the inner tube 16 includes a plurality of tube segments 32, connected to one another by inner connecting ferrules 34. Each tube segment 32 has the dimensions set out above, and is made from the material indicated above.

The inner tube 16, and more particularly each of these segments 32, is solid. This means that the inner tube has no slots, openings or apertures, cut into the inner tube. Thus, the drilling fluid is confined to the inside of the inner tube 16 and cannot circulate between the inner tube and the wall of the tube 10.

The inner connecting ferrule 34 may be of any suitable type.

In the illustrated example, each segment 32 has an outer thread 35 at its upper end 36. The upper end 36 has a smaller thickness, the outer surface of the segment 32 being hollowed out in line with the upper end 36.

The lower end 38 of the segment 32 has an inner thread 40. The lower end 38 has a smaller thickness, by hollowing out the inner face of the segment 32 at the end 38.

Each inner connecting ferrule includes a central tubular portion 42, extended longitudinally upward by an upper tubular portion 44 and downward by a lower tubular portion 46. The upper tubular portion 44 has an outer thread 48, intended to cooperate with the inner thread 40 of the lower end of a tube segment 32. The lower tubular portion 46 in turn bears an inner thread 50, intended to cooperate with the outer thread 34 of the upper end of another tube segment 32.

As shown in FIG. 3, the central tubular portion 42 has substantially the same thickness as the tube segments 32. Furthermore, the cumulative thickness of the upper tubular portion 44 and the lower end 38 substantially corresponds to the thickness of a tube segment 32. Likewise, the cumulative thickness of the lower tubular portion 46 and the upper end 36 substantially corresponds to the thickness of a tube segment 32. Thus, each inner connecting ferrule 34 fits exactly in the extension of the two segments 32 connected by said ferrule 34.

The outer sheath 18 in turn also comprises a plurality of sheath segments 52, connected to one another by outer connecting ferrules 54. Each outer connecting ferrule 54 has a cylindrical shape. It is defined longitudinally toward the bottom of the hole and toward the inlet by lower and upper edges 56 and 58, in which grooves 60, 62, respectively, are arranged. The grooves 60, 62 are substantially cylindrical. The groove 60 is provided to receive an upper longitudinal end of a sheath segment 52. The groove 62 is provided to receive a lower longitudinal end of another sheath segment.

The device for placing the tube 10 is provided, during the digging step, to introduce the tube segments 32 and the sheath segments 52 one by one into the hole 6, as the drilling advances. An inner connecting ferrule 34 is inserted between two successive tube segments 32. Likewise, an outer connecting ferrule 54 is inserted between two successive sheath segments 52.

Furthermore, and as shown in FIG. 3, the tube 14 comprises a plurality of members 64 connecting the outer sheath 18 and the inner tube 16 to one another, arranged such that the inner tube 16 is longitudinally connected to the outer sheath 18 in translation toward the bottom of the hole 10, and is longitudinally free relative to the outer sheath 18 in translation toward an inlet of the hole.

Thus, during the digging of the hole 10, it is the inner tube 16 that drives the outer sheath 18 toward the bottom of the hole, as the drilling advances.

This advance for example results in percussion applied to the drilling head or the inner tube.

This percussion is not applied to the outer sheath, such that the latter is not damaged by the percussion.

In the illustrated example, each connecting member 64 is supported by an inner connecting ferrule 34, and cooperates with an outer connecting ferrule 54 to connect the inner tube 16 longitudinally to the outer sheath 18 in translation toward the bottom of the hole.

Alternatively, each connecting member 64 is supported by an outer connecting ferrule 54 and cooperates with an inner connecting ferrule 34.

In the illustrated example, each member 64 includes a bolt 66 mounted pivoting on an inner connecting ferrule 34 around an axis 68. The bolt 66 is rotatable around the axis 68, between a position retracted inside a housing 70 arranged in the inner connecting ferrule 34, and the blocking position, in which the bolt 66 protrudes outside the housing 70.

In the retracted position, the bolt is completely housed in the housing 70. In the blocking position, the bolt 66 extends, from the axis 68, longitudinally toward the bottom of the hole, and radially toward the outer sheath. One end 74 of the bolt, opposite the axis 68, protrudes radially relative to the surface 72 outside the housing 70.

As shown in FIG. 3, the end 74 is engaged in a concavity 76 hollowed in a radially inner surface of the outer connecting ferrule 54.

A return spring, not shown, urges the bolt 66 toward its blocking position.

The device 20 provided to remove the inner tube from the hole 6 preferably includes means 83 for blocking the outer sheath 18 in place inside the hole, during the removal of the inner tube 16. This blocking is typically done at the head, at the end of the outer sheath 18 situated at the inlet of hole. The blocking is done using any appropriate means. It should be noted that the pressure exerted by the terrain on the outer sheath contributes to blocking the outer sheath 18 in place inside the hole, during the removal of the inner tube 16.

The assembly 2 also includes a pressure meter probe 86, with an appropriate size to be inserted into the outer sheath 18 (FIG. 1*c*). The pressure meter probe 86 includes a radially deformable cell 88, a unit 90 for supplying the cell 88 with an incompressible fluid, and a controller 92. The unit 90 is provided to supply the deformable cell 88 with fluid at a pressure that may vary in a predetermined range. The controller 92 controls the unit 90 according to a predetermined program, and varies the pressure inside the cell 88 as a function of time, according to a predetermined pressure-time curve recorded in the controller 92.

The assembly 2 further includes a device 94 for moving the pressure meter probe 86, longitudinally along the hole 6, inside the outer sheath 18. The pressure meter probe 86 can thus be moved successively to several positions distributed along the hole, and perform a pressure meter test in each of said positions.

In order to facilitate the deformation of the outer sheath 18 upon each pressure meter test, the outer sheath 18 advantageously includes weak spots 96, distributed longitudinally along the outer sheath 18. These weak spots contribute to ensuring that the outer sheath 18 has a specific ultimate strength of less than 1 bar. Conversely, it is important to note that these weak spots do not deteriorate the compression strength of the sheath.

For example, the weak spots 96 are slots arranged in the outer sheath. Alternatively, they are thinner lines of material, facilitating tearing of the outer sheath.

For example, the weak spots 96 are made before placing the outer sheath inside the tube, typically during production of the outer sheath.

Alternatively, the weak spots 96 are made after placing the outer sheath inside the hole. For example, the pressure meter probe 86 is equipped with knives, arranged so as to create the weak spots in the outer sheath 18 when the pressure meter probe 86 moves along the outer sheath.

The weak spots 96 are for example made over the entire length of the outer sheath 18. Alternatively, they are made only at positions where the pressure meter tests must be carried out.

Alternatively, the outer sheath does not have any weak spots, the specific ultimate strength of the sheath being obtained by choosing the thickness and nature of the material appropriately.

The method according to the invention will now be described.

The method includes a step for digging the hole 6 in the ground with lining of the hole 6 simultaneously by the tube 14 (FIG. 1*a* and FIG. 2).

The tube 14 is placed gradually, as the whole 6 is dug.

The tube 14 extends continuously over the entire longitudinal length of the hole 6.

Tube segments 32 and sheath segments 52 are added in the hole 6, to form the inner tube and the outer sheath, as the drilling is done. Between each pair of consecutive tube segments 32, an inner connecting ferrule 34 is inserted. Likewise, between each pair of consecutive sheath segments 52, an outer connecting ferrule 54 is placed.

The tube segments 32 and the sheath segments 52 longitudinally have substantially the same length. Thus, the inner connecting ferrules 34 and the outer connecting ferrules 54 are always placed across from one another.

The inner connecting ferrules 34 and the outer connecting ferrules 54 are oriented circumferentially such that each connecting member 64 is engaged in a concavity 76.

During the digging step, when the latter is done using the drilling tool with rotary percussion 20 of the type shown in FIG. 2, the drilling head 22 is rotated relative to the inner tube 16 by the device 24. The inner tube 16 is fixed in rotation relative to the ground. The drilling head 22 is rotated by the set of rods 31.

As the drilling advances, new rods are added to the set of rods 31.

Furthermore, percussion is applied to the drilling head 22 by the device 26 provided to that end. The percussion is transmitted to the inner tube 16 by the drilling head 22 and/or is applied directly to the inner tube 16 by the device 26.

Thus, during the drilling, the drilling head 22 and the inner tube 16 progress together along the hole 6.

The inner tube 16, as it moves longitudinally toward the bottom of the hole 6, drives the outer sheath 18, via the connecting members 64.

Indeed, the ends 74 of each bolt 66 bear on a bottom of the concavity 76, and thus urge the outer sleeve 18 longitudinally toward the bottom of the hole. The orientation of the bolt 66 allows this force to be transmitted.

The method further includes, after the step of digging the hole 6, a raising step (FIG. 1*b*) during which the inner tube 16 is removed from the hole 6, the outer sheath 18 remaining in place inside the hole 6.

The inner tube 16 is moved longitudinally toward the inlet of the hole 6, by the device 20 provided to that end. The tube segments 32 are disassembled as they leave the hole 6.

The connecting members 64 do not oppose the movement of the inner tube 16 relative to the outer sheath 18. Due to the orientation of the bolts 66, the longitudinal movement of the inner tube 16 relative to the outer sheath 18 toward the inlet of the hole 6 causes the bolts 66 to move toward their retracted positions inside the housings 70.

During the raising step, the outer sheath 18 is blocked in position inside the hole 6 by the means 83 provided to that end, and also by the pressure exerted by the terrain.

The method includes, after the raising step, a step for inserting the pressure meter probe 86 into the outer sheath 18 (FIG. 1*c*), followed by one or several measuring steps (FIG. 1*d*).

The measuring step is repeated in several positions distributed longitudinally along the hole 6.

The first measuring step is carried out by placing the pressure meter probe 86 at the bottom of the hole 6, the pressure meter probe 86 next being moved successively from the bottom of the hole 6 toward the inlet of the hole 6. The outer sheath 18 is not moved between the measuring steps. It remains in place, in the same position.

Thus, the first measuring step is carried out with the probe 86 at the bottom of the hole 6, the second measuring step is carried out immediately above the first measuring step, the third measuring step immediately above the second measuring step, and so forth until the inlet of the hole 6.

Between two measuring steps, the pressure meter probe 86 is moved by the device 94 provided to that end.

During each measuring step, the deformable cell 88 of the pressure meter probe is inflated by the device 90, by injecting an incompressible fluid into the cell 88. The control device 92 controls the device 90, such that the latter inflates the deformable cell following a predetermined pressure-time curve.

The cell 88, upon inflating, will be pressed radially against the outer sheath and urges the latter against the wall of the hole. Thus, the cell 88 will deform the outer sheath permanently, as illustrated in FIG. 1. The deformation of the outer sheath is made easier by the weak spots 96.

The control device 92 records the volume injected as a function of the pressure. The characteristics of the ground are next calculated from the recorded values.

The method and the assembly allowing the implementation of this method have many advantages.

Because a lining is placed in the hole during digging of this hole, no terrain decompression occurs near the hole, or any collapse of the hole. The fact that the tube includes a relatively rigid inner tube makes it possible to insert this tube into the hole during drilling, without the tube being damaged. The fact that the relatively more rigid inner tube is removed from the hole, while only leaving the relatively less rigid inner sheath in place makes it possible to improve the quality of the results of any pressure meter tests. The outer sheath in fact deforms easily when the pressure meter probe is inflated.

Furthermore, the outer sheath is rigid enough to prevent the hole from collapsing. The stresses applied by the walls of the hole on the outer sheath are moderate. The circular geometry of the outer sheath gives it good strength with respect to radial pressures, despite its small thickness.

The above method makes it possible to place the outer sheath in the immediate vicinity of the wall of the hole, typically less than 4 mm from the wall of the hole, and preferably less than 2 mm from the wall of the hole. This limits the reworking of the materials at the periphery of the hole, and guarantees good representativeness of any pressure meter tests.

The fact that the inner tube is solid means that the drilling fluid cannot circulate between the inner tube and the wall of the hole, which contributes to the good drilling quality.

Using a drilling tool with rotary percussion, having a drilling head mounted rotating on the inner tube and a device transmitting percussion to the drilling head and/or to the inner tube makes it possible to drill very effectively, through any type of ground. Such a tool also makes it possible to place the tube practically instantaneously behind the drilling tool. The tube does not rotate, but is translated, such that the materials at the periphery of the hole are not reworked.

The connecting members connecting the outer sheath and the inner tube to one another allow the inner tube to drive the translation of the outer sheath toward the bottom of the hole, while allowing easy removal of the inner tube from the hole, without driving the outer sheath. Using a lubricating fluid during the step for raising the inner tube also contributes to this result.

It should be noted that the drilling method and assembly according to the invention can be used for applications other than pressure meter tests, for example for logs or seismic tests.

What is claimed is:

1. A method for carrying out a pressuremeter test, the method comprising:

digging a longitudinal hole in an area of ground, and simultaneously lining the hole with a tube extending substantially over an entire longitudinal length of the hole, the tube comprising an inner tube and an outer tubular sheath inserted between the inner tube and a wall of the hole, after digging the hole, removing the inner tube from the hole, with the outer sheath remaining in place inside the hole;

inserting a pressuremeter probe into the outer sheath;

inflating a deformable cell of the pressuremeter probe by a fluid, the cell radially stressing the outer sheath against the wall of the hole; and measuring pressure using the pressuremeter probe.

2. The method according to claim 1, wherein the measuring is repeated in several positions distributed longitudinally along the hole, by moving the pressuremeter probe successively from a bottom of the hole toward an inlet of the hole, the outer sheath not being moved.

3. The method according to claim 1, wherein the outer sheath has a specific ultimate strength of less than or equal to 1 bar.

4. The method according to claim 3, wherein the specific ultimate strength is less than 0.8 bars.

5. The method according to claim 1, wherein the outer sheath is provided not to deform under the effect of an outside radial pressure comprised between 0.2 and 2 bars.

6. The method according to claim 1, wherein the outer sheath is made from a plastic material.

7. The method according to claim 1, wherein the outer sheath has a thickness comprised between 1 and 4 mm.

8. The method according to claim 1, wherein the inner tube has an outer diameter, the outer sheath having an inner diameter, the difference between the inner diameter and the outer diameter being comprised between 2 and 8 mm.

9. The method according to claim 1, wherein the outer sheath includes longitudinal weak spots, distributed on the periphery of the outer sheath.

10. The method according to claim 9, wherein the weak spots are made after placing the outer sheath inside the hole.

11. The method according to claim 1, wherein the outer sheath is blocked in position during the removing.

12. A kit for carrying out a pressuremeter test, the kit comprising:

a digger comprising a drill for drilling a longitudinal hole in an area of ground;

a tube configured to extend substantially over an entire longitudinal length of the hole, the tube comprising an inner tube and an outer tubular sheath inserted between the inner tube and a wall of the hole;

a tube-pusher configured to place the tube in the hole simultaneously with drilling;

a block configured to hold the outer sheath in place inside the hole while the inner tube is removed from the hole;

a pressuremeter probe configured to be inserted into the outer sheath, including a deformable cell;

an inflator configured to inflate the deformable cell using a fluid, such that the deformable cell radially stresses the outer sheath against the wall of the hole.

13. The kit according to claim 12, wherein the kit comprises a lift configured to move the pressuremeter probe successively to several positions distributed longitudinally along the hole, from a bottom of the hole toward an inlet of the hole, without moving the outer sheath.

14. The kit according to claim 12, wherein the tube comprises a plurality of connectors connecting the outer sheath and the inner tube to one another, the connectors being arranged such that the inner tube is longitudinally connected to the outer sheath in translation toward the bottom of the hole, and the inner tube is longitudinally free relative to the outer sheath in translation toward an inlet of the hole.

15. The kit according to claim 14, wherein the inner tube comprises a plurality of tube segments connected to one another by inner connecting ferrules;

the outer sheath comprises a plurality of sheath segments connected to one another by outer connecting ferrules;

each connector being supported by one of the inner connecting ferrules and cooperating with one of the outer connecting ferrules to connect the inner tube longitudinally to the outer sheath in translation toward the bottom of the hole; or each connector being supported by one of the outer connecting ferrules and cooperating with one of the inner connecting ferrules to connect the inner tube longitudinally to the outer sheath in translation toward the bottom of the hole.

* * * * *